US008201961B2

(12) United States Patent
Lau

(10) Patent No.: US 8,201,961 B2
(45) Date of Patent: Jun. 19, 2012

(54) ROTATABLE HEADLAMP

(76) Inventor: Chi Hung Fermi Lau, Kowloon (HK)

( * ) Notice: Subject to any disclaimer, the term of this patent is extended or adjusted under 35 U.S.C. 154(b) by 213 days.

(21) Appl. No.: 12/658,423

(22) Filed: Feb. 10, 2010

(65) Prior Publication Data

US 2010/0177504 A1 Jul. 15, 2010

Related U.S. Application Data

(63) Continuation-in-part of application No. 12/386,809, filed on Apr. 22, 2009.

(60) Provisional application No. 61/204,949, filed on Jan. 12, 2009.

(51) Int. Cl.
*F21V 21/084* (2006.01)

(52) U.S. Cl. ..... 362/105; 362/194

(58) Field of Classification Search ..... 362/103, 362/105–107, 164, 183, 184, 190, 191, 212, 362/194

See application file for complete search history.

(56) References Cited

U.S. PATENT DOCUMENTS

| | | | | |
|---|---|---|---|---|
| 3,250,909 | A * | 5/1966 | Oldenburger | 362/205 |
| 6,575,587 | B2 * | 6/2003 | Cramer et al. | 362/105 |
| 7,425,082 | B1 * | 9/2008 | Jones | 362/285 |
| 2005/0002186 | A1 * | 1/2005 | Krieger et al. | 362/183 |
| 2005/0157492 | A1 * | 7/2005 | Chiu | 362/184 |

* cited by examiner

*Primary Examiner* — Julie Shallenberger
(74) *Attorney, Agent, or Firm* — Raymond Y. Chan; David and Raymond Patent Firm

(57) ABSTRACT

A rotatable headlamp includes a light head, a rechargeable power source, a mounting arrangement and a rechargeable dock. The light head includes a light housing having a light window, and a LED light source supported in the light housing to align with the light window. The mounting arrangement is movably coupled with the light housing to selectively adjust a light projecting orientation of the LED light source through the light window. The rechargeable dock, which is adapted for electrically connecting with an external power supply, has a docking cavity detachably receiving the light head to charge the rechargeable power source. A rotating member is further provided for detachably mounting to the mounting panel for selective adjusting the light projecting angle in three-dimensional manner.

13 Claims, 12 Drawing Sheets

ROTATABLE HEADLAMP

CROSS REFERENCE OF RELATED APPLICATION

This is a Continuation-In-Part application that claims the benefit of priority under 35U.S.C.§120 to a non-provisional application having an application Ser. No. 12/386,809 and a filing date of Apr. 22, 2009, which claims the benefit of priority under 35U.S.C.§119(e) to a provisional application having an application No. 61/204,949 and a filing date of Jan. 12, 2009.

BACKGROUND OF THE PRESENT INVENTION

1. Field of Invention

The present invention relates to a lamp, and more particularly to a rotatable headlamp comprising a mounting arrangement and a rechargeable dock which are capable of allowing convenient adjustment of an angle of inclination of a light head and recharging thereof respectively.

2. Description of Related Arts

A conventional headlamp typically comprises a housing, a power source provided within the housing and an illuminating unit mounted in the housing and electrically connected with the power source, wherein the housing is adapted for wearing on a user's head through a strap so that a user is able to wear the headlamp on his or her head for providing illumination when he or she is performing some duties or personal work.

There several disadvantages for this kind of conventional headlamp. First, the headlamp must be affixed to the strap before it can be worn on the user's head. The conventional method is to affix the housing to the strap with little or no room for the housing to move with respective to the strap. In other words, when the housing is affixed to the strap, the illuminating angle of the illuminating unit cannot be freely adjusted. This present a great due of inconvenience to the user because when the user is wearing the headlamp on his or her head and he or she is in the course of performing some tasks, and when the user needs to adjust the angle of illumination so that he or she can view a particular object more clearly, the user has no choice but to either move his or her head to acquire the necessary angle of illumination, or detach the headlamp from his or her head and re-adjust the angle of inclination between the headlamp and the strap. Even this, the latter option may not be available because conventional headlamp may not provide connectors which facilitate pivotal movement between the housing or illumination unit with respective to the strap.

Second, recharging issues of conventional headlamp presents another disadvantage. For conventional headlamp, in order to recharge, the user has to detach the rechargeable battery for recharging. This also induces a great due of inconvenience to the user. When the rechargeable battery is detached from the headlamp, the user has to utilize designated charging equipment, such as a predetermined charger, for charging the rechargeable battery. Very often, however, the charger and the headlamp are separately located so that one may not be able to get the predetermined charger quick enough to resume the operation of the headlamp promptly.

Furthermore, even if the orientation the headlamp for attaching onto a head band is adjustable, the projecting angle of the headlamp is limited within a predetermined angle or can only be moved in one direction. Therefore, the headlamp is unable to be flexibly rotated for illuminating the desired working area.

SUMMARY OF THE PRESENT INVENTION

An object of the present invention is to provide a rotatable headlamp, which is able to be flexibly rotated in 3-dimentional manner.

Another object of the present invention is to provide a rotatable headlamp, which comprises a rotating member detachably coupling with the headlamp for Another object of the present invention is to provide a rotatable headlamp comprising a mounting arrangement and a rechargeable dock which are capable of allowing convenient adjustment of an angle of inclination of a light head and recharging thereof respectively Another object of the present invention is to provide a rotatable headlamp comprising a mounting arrangement which allows the headlamp to be pivotally adjustable for a user to freely adjust the orientation of the illumination produced by the rotatable headlamp.

Another object of the present invention is to provide a rotatable headlamp comprising a rechargeable dock which is adapted to receive and electrically connect to a light head so as to allow recharging of the light head by electrically connecting the rechargeable dock to an external power source, such as an external AC power source.

Another object of the present invention is to provide a rotatable headlamp, wherein the rechargeable dock and the mounting arrangement are arranged to couple with a light head to form a single compact unit, so that the user is able to carry and use the rotatable headlamp in a convenient and efficient manner.

Another object of the present invention is to provide a Rotatable headlamp, which does not substantially alter the traditional structure of the light head, so as to minimize the manufacturing cost of the present invention, and to facilitate widespread application of the present invention.

Accordingly, in order to accomplish the above objects, the present invention provides a rotatable headlamp, comprising:

a light head comprising a light housing having a light window, and a LED light source supported in the light housing to align with the light window;

a rechargeable power source supported in the light housing;

a mounting arrangement movably coupling with the light housing to selectively adjust a light projecting orientation of the LED light source through the light window; and a rechargeable dock, which is adapted for electrically connecting with an external power supply, having a docking cavity detachably receiving the light head to charge the rechargeable power source.

Accordingly, a rotating member may further provided for rotatably and detachably coupling with a mounting panel of the mounting arrangement for rotatably adjusting the light oriental of the light head along an attachment surface of the rotating member, so as to selectively adjust the light projecting angle in 2-dimensional manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
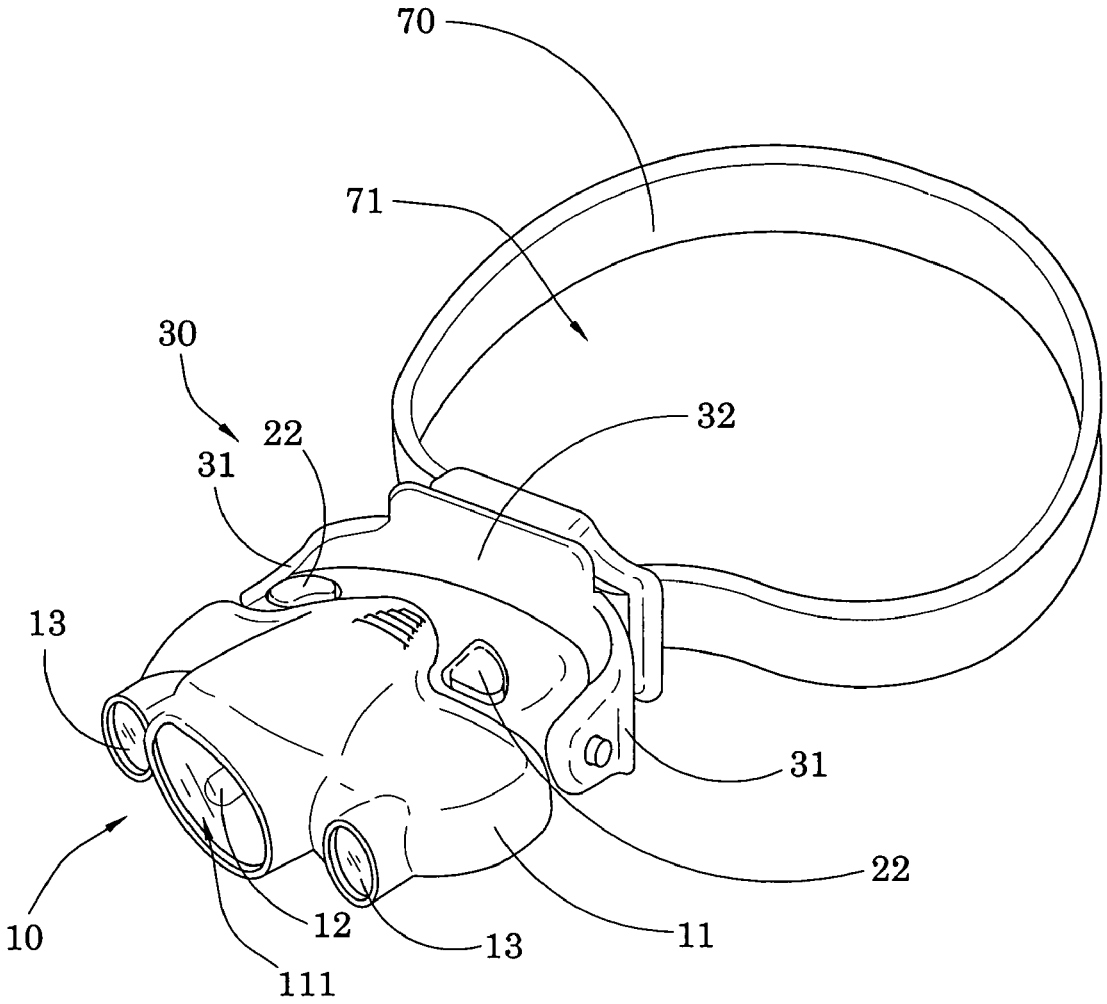
FIG. 1 is a perspective view of a rotatable headlamp according to a preferred embodiment of the present invention.
Figure 2A:
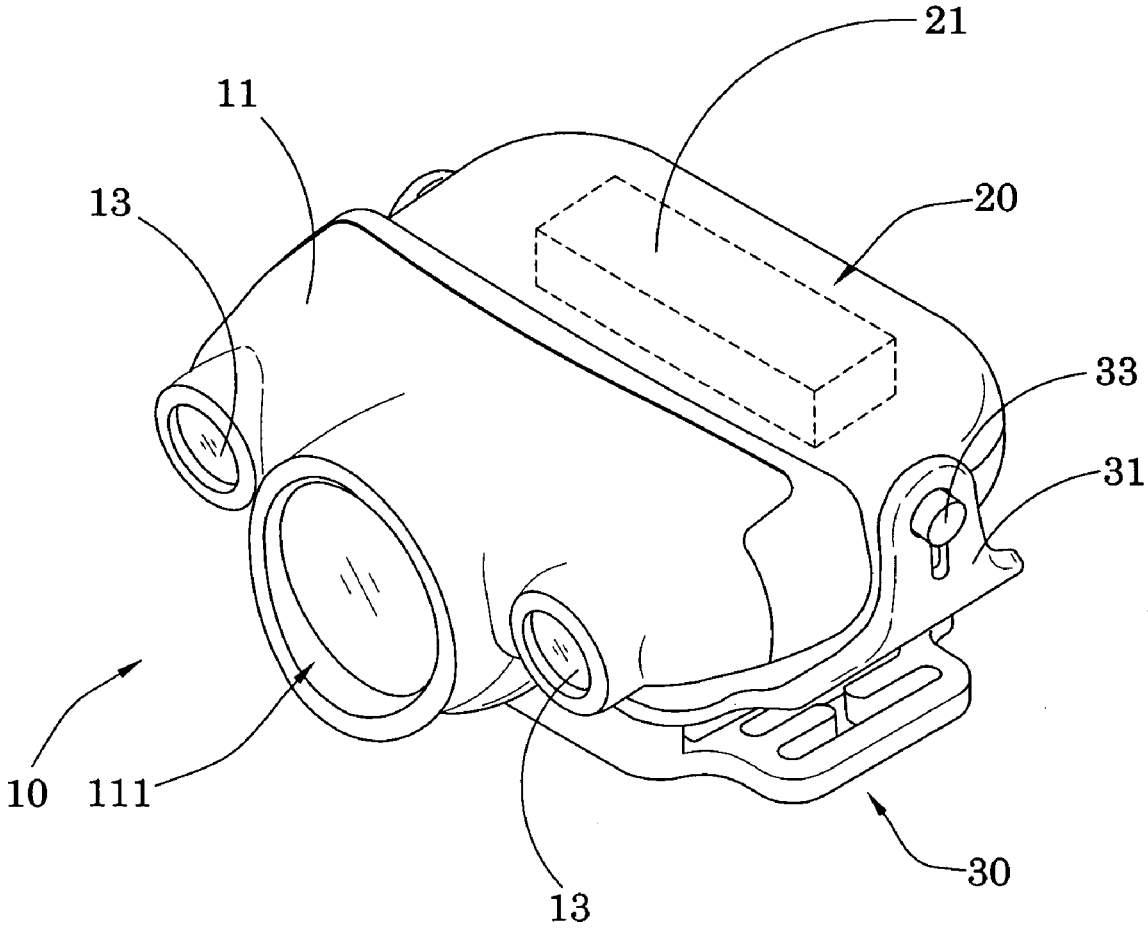
FIG. 2A and FIG. 2B are schematic diagrams of the rotatable headlamp according to the above preferred embodiment of the present invention, illustrating that the mounting arrangement is mounted on the light head.
Figure 2B:
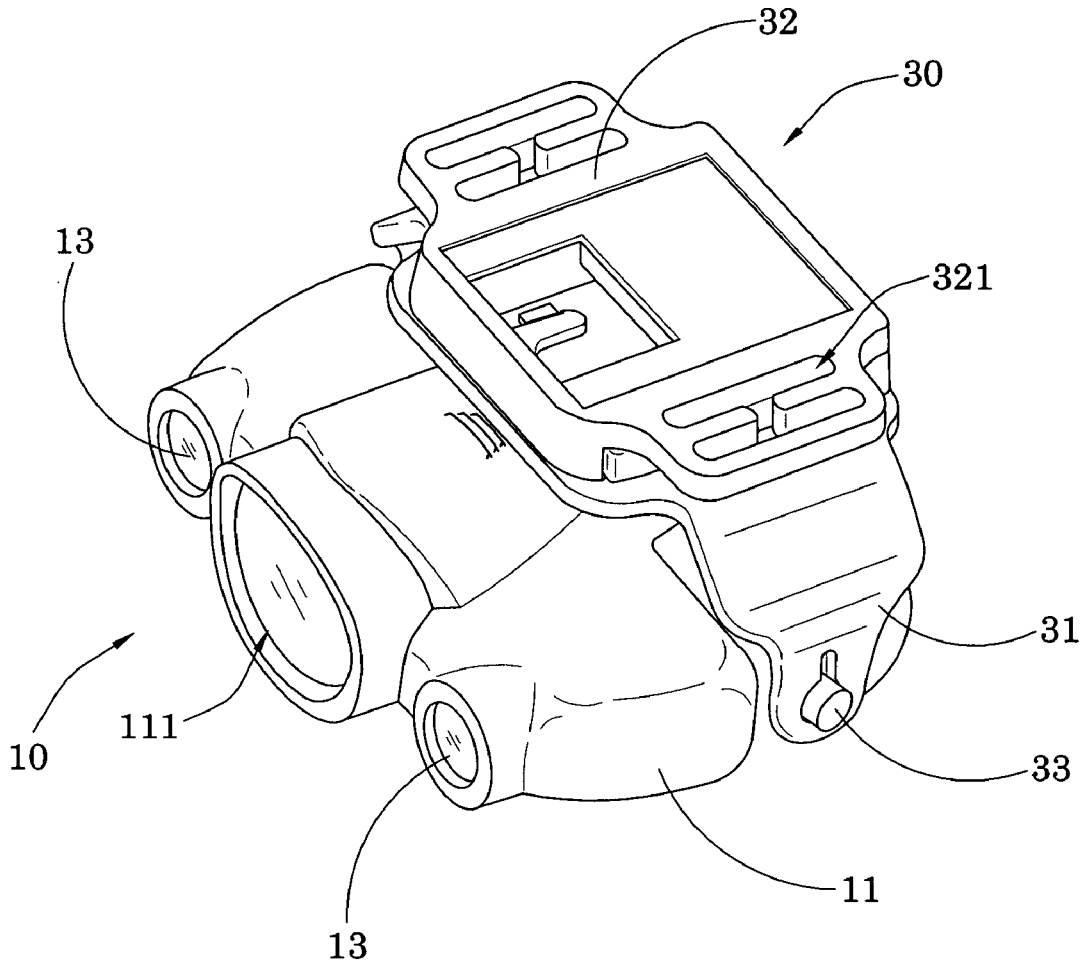
Figure 3A:
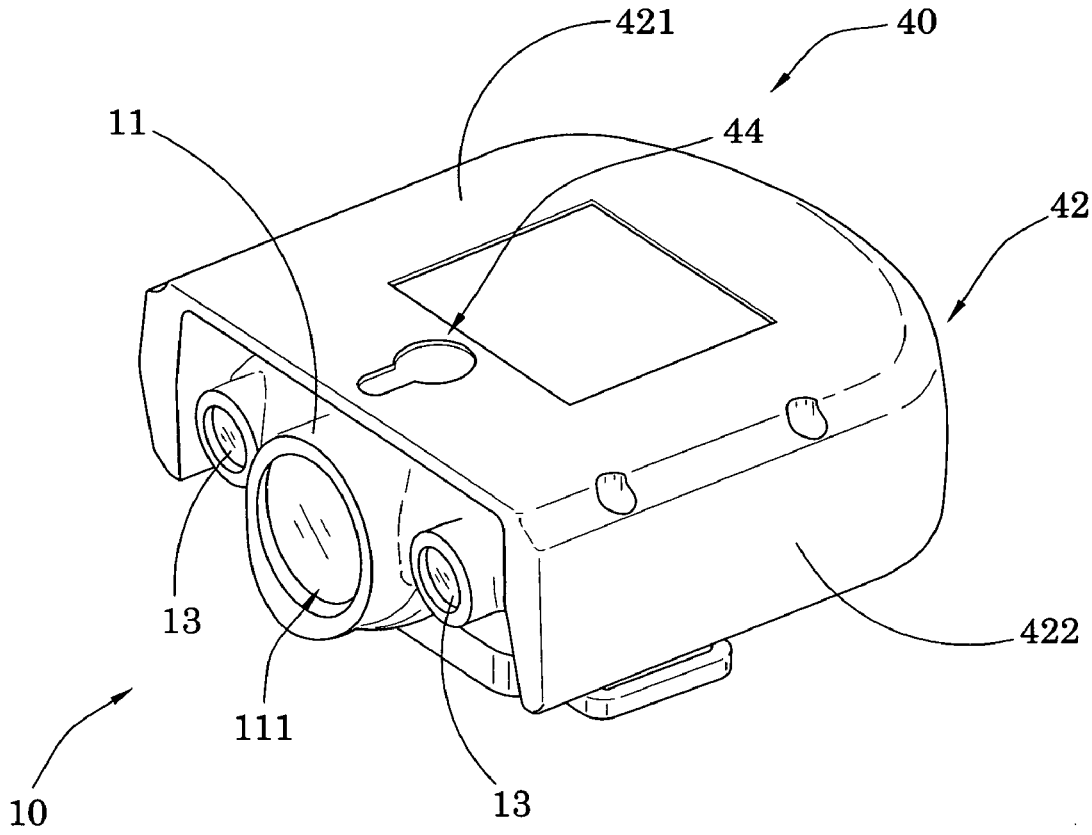
FIG. 3A and FIG. 3B are schematic diagrams of the rotatable headlamp according to the above preferred embodiment of the present invention, illustrating that the rechargeable dock is mounted on the light head.
Figure 3B:
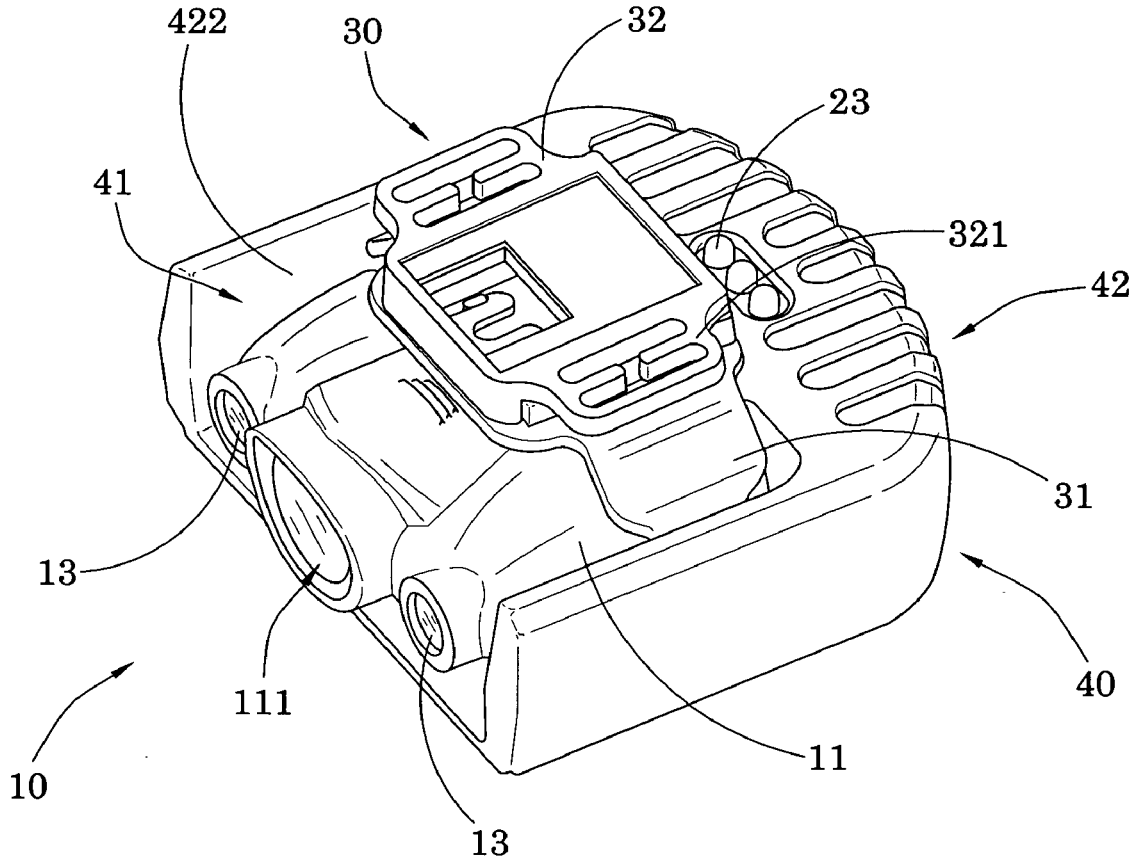
Figure 4:
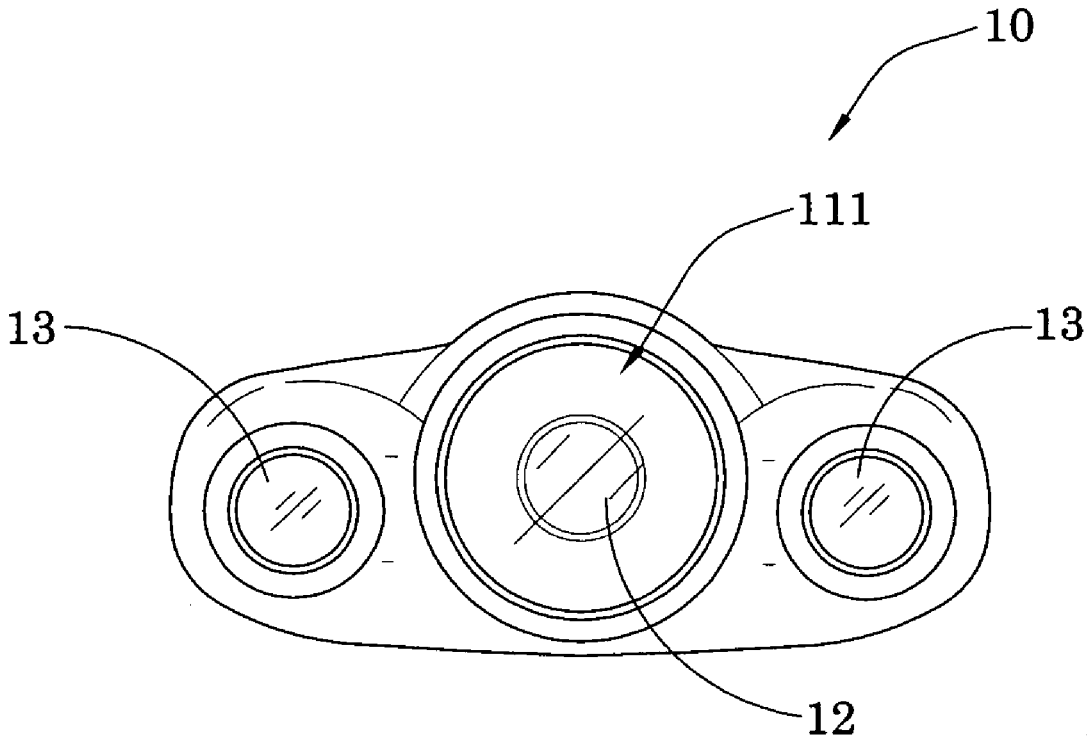
FIG. 4 is a front view of the rotatable headlamp according to the above preferred embodiment of the present invention.

Referring to FIG. 1, FIG. 2A, FIG. 2B, FIG. 3A, FIG. 3B and FIG. 4 of the drawings, a rotatable headlamp according to a preferred embodiment of the present invention is illustrated, in which the rotatable headlamp comprises a light head 10, a rechargeable power source 20, a mounting arrangement 30 and a rechargeable dock 40.

The light head 10 comprises a light housing 11 having a light window 111, and a LED light source 12 supported in the light housing 11 to align with the light window 111 so that the LED light source 12 is arranged to deliver illumination to an exterior of the light housing 11 through the light window 111. On the other hand, the rechargeable power source 20 is supported in the light housing 11 to provide electricity to the LED light source for allowing illumination thereof.

The mounting arrangement 30 is movably coupled with the light housing 11 to selectively adjust a light projecting orientation of the LED light source 12 through the light window 111. Accordingly, the mounting arrangement 30 is adapted for detachably mounting at a desired object, such as a user' head or a cap worn by the user, to retain the light housing 11 in position. In other words, the adjustable light projecting orientation allows a user to freely control the orientation of the illumination generated by the LED light source 12 for illuminating specific location designated by the user with respect to the desired object.

The rechargeable dock 40, which is adapted for electrically connecting with an external power supply, such as an external AC power supply, has a docking cavity 41 detachably adapted for receiving the light head 10 to charge the rechargeable power source 20.

According to the preferred embodiment of the present invention, the mounting arrangement 30 comprises two retention walls 31 rotatably and pivotally coupling with two sides of the light housing 11 to selectively adjust the light projecting orientation of the LED light source 12, and a mounting panel 32 extended between the retention walls 31 to form a U-shaped member, wherein the light housing 11 is arranged to be freely and pivotally move with respect to the mounting arrangement 30 for selectively adjusting the angle of illumination by the LED light source 12. It is worth mentioning that the pivotal coupling between the retention walls 31 and the light housing 11 can be accomplished by various conventional means, such as two screw connectors 33.

In order to allow the light head 10 to be worn on a user's head, the mounting panel 32 is arranged to be attached with a strap or a headband 70 for wearing on the user's head. As a result, the mounting panel 32 has a plurality of band slots 321 spacedly formed thereat for a headband 70 detachably fastening at the mounting panel 32 at the corresponding band slots 321 so as to enable the light head 10 being carried at a head portion of a user via the headband 70. The headband 70 is arranged to be length-adjustable so as to fit differing head sizes of different users. The headband 70 should be made of flexible materials, such as durable fabric or elastic material, for allowing the user to conveniently wear on his or her head and detach the rotatable headlamp from the body. Furthermore, each of the band slots 321 is preferably elongated in shape and is longitudinally and spacedly formed on the mounting panel 32 of the mounting arrangement 30 so as to allow the corresponding headband 70 to attach at the band slots 321 in such a manner that the headband 70 is arranged to form a wearing loop 71 adjustable to fittedly receive a user's head, so that the light housing 11 is mounted at a forehead of the user and that the light window 111 is oriented to provide illumination at a front side of the user's forehead, yet with adjustable angle of orientation through pivotal movement of the light housing 11.

On the other hand, the rechargeable power source 20 comprises a rechargeable battery 21 which is preferably embodied as a Li-ion rechargeable battery supported in the light housing 11, and two switch controls 22 spacedly provided at the light housing 11 for controllably switching the LED light source 12 in an on and off manner. As shown in FIG. 1, the two switch controls 22 are spacedly provided on the top side of the light housing 11 for easy accessing.

The rechargeable power source 20 further comprises a charging terminal 24 provided at the bottom side of the light housing 11 to electrically extend from the rechargeable battery 21.

In order to provide better illumination for the rotatable headlamp, the light head 10 further comprises two auxiliary light sources 13 provided at the light housing 11 at a position that the LED light source 12 is positioned between the auxiliary light sources 13, wherein each of the auxiliary light sources 13 has the same light projecting orientation of the LED light source 12 for providing additional light to illuminate a designated area or a targeted object aimed by the LED light source 12. The auxiliary light sources 13 are also electrically connected with the rechargeable power source 20 for acquiring electricity to provide additional lighting performance of the rotatable headlamp. According to the preferred embodiment of the present invention, the LED light source 12 is preferably embodied as an ultra power cree LED bulb while the auxiliary light sources 13 are embodied as white LED bulbs respectively. Together, they provide an optimal level of light directed at a predetermined or a desirable location through adjustment of the light housing 10 with respective to the mounting arrangement 30.

It is worth mentioning that the switch controls 22 are arranged to selectively operate the LED light source 12 and/or the auxiliary light sources 13 (i.e. a dual switch control) so that a user is allowed to select which light source (i.e. either the LED light source 12 or at least one of the auxiliary light source 13) or both light sources are to be utilized.

Preferably, one of the switch controls 22 is arranged to switch one of the LED light source 12 and the auxiliary light sources 13 in an on and off manner, while another switch control 22 is arranged to switch between a main light mode and an auxiliary light mode. Accordingly, the main light mode is that the LED light source 12 is activated and the auxiliary light mode is that the auxiliary light sources 13 are activated.

Referring to FIG. 1, FIG. 2A, FIG. 2B, FIG. 3A, FIG. 3B and FIG. 4 of the drawings, the rechargeable power source 20 further comprises a LED charging indicator 23 provided on the rechargeable dock 40 for indicating a status of the rechargeable power source 20. The LED charging indicator 23 can be embodied as at least one LED provided on the rechargeable dock 40 for illuminating a particular color of light to indicate the corresponding charging status. For example, a green light may represent that the rechargeable power source 20 has been fully charged, while a yellow light represents that the rechargeable power source 20 is being properly recharged.

The rechargeable dock 40 comprises a dock body 42 having a docking base 421 and at least one side docking wall 422, preferably two side docking walls, integrally extended from the docking base 421 to form the docking cavity 41 within the docking base 421 and the side docking wall 422. The rechargeable dock 40 further comprises an electric terminal 43 provided within the docking cavity 41 either on the docking base 421 or the side docking wall 422 for electrically connecting the light head 10 with an external power source, such as an external AC power source.

Figure 5:
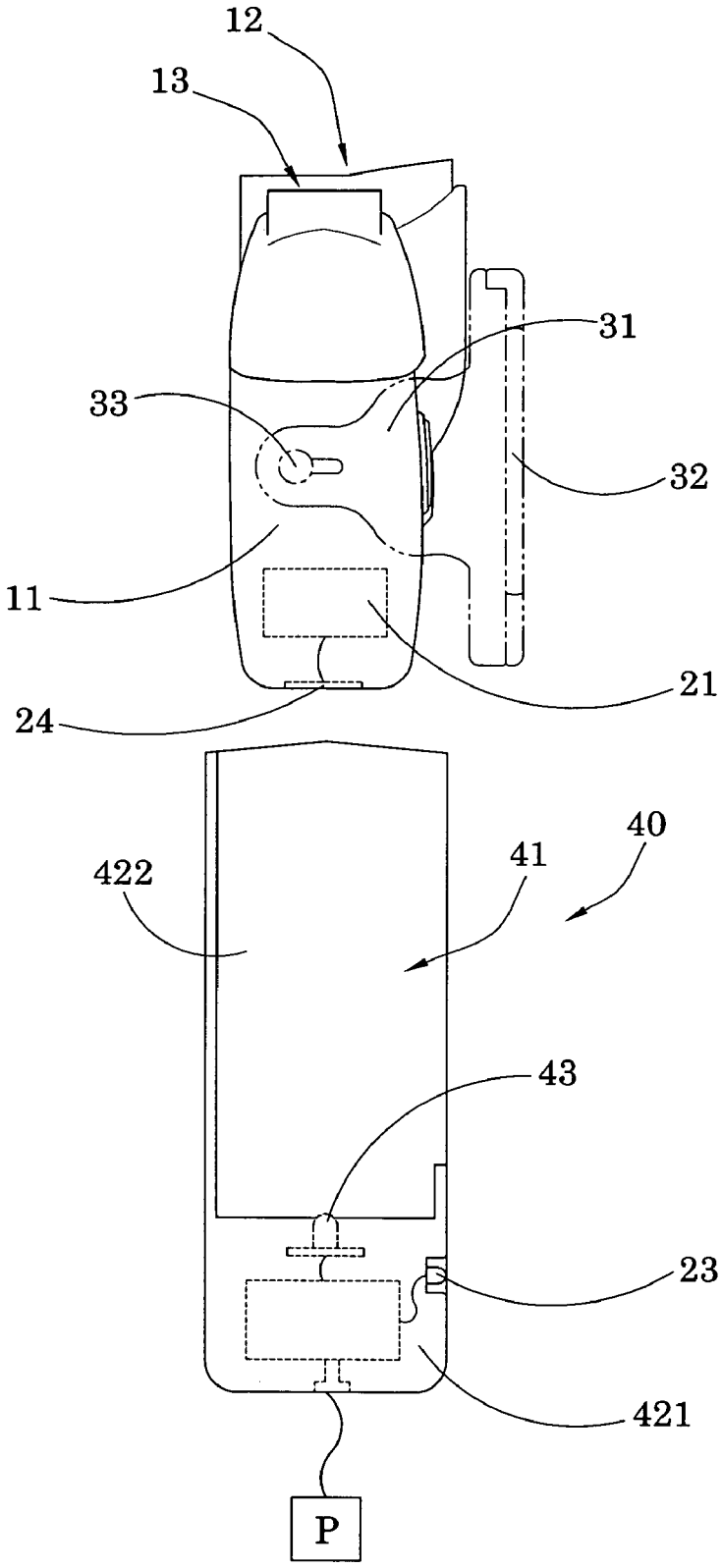
FIG. 5 is a side view of the rotatable headlamp according to the above preferred embodiment of the present invention, illustrating the charging terminal of the light head being contacted with the electric terminal of the rechargeable dock for recharging purpose.

As shown in FIG. 5, the electric terminal 43 is provided at the bottom wall of the docking cavity 41 to electrically contact with the charging terminal 24 of the rechargeable power source 20 when the light housing 11 is disposed within the docking cavity 41 so as to recharge the rechargeable battery 21. It is worth mentioning that the light head 10 can be disposed at the docking cavity 41 of the rechargeable dock 40 without detaching the mounting arrangement 30 from the light head 10. In other words, the mounting arrangement 30 is pivotally folded at the top side of the light head 10 in order to dispose the light head 10 at the docking cavity 41 of the rechargeable dock 40.

In order to impart wider application of the present invention, the rechargeable dock 40 contains a wall mounting slot 44 provided at the rear side of the rechargeable dock 40 for detachably mounting the rechargeable dock 40 on a wall surface via a fastener, such that when the light head 10 is received in the rechargeable dock 40, the light head 10 forms a wall light for illumination. In addition, the rechargeable dock 40 can be suspendedly hung on the wall surface to recharge the rechargeable battery 21 when the light head 10 is disposed at the rechargeable dock 40.

The light housing 11 and the mounting arrangement 30 and the rechargeable dock 40 are preferably made of durable yet reasonably light materials such as ABS plastic for allowing the user to utilize the present invention in a wide variety of circumstances.

Figure 6:
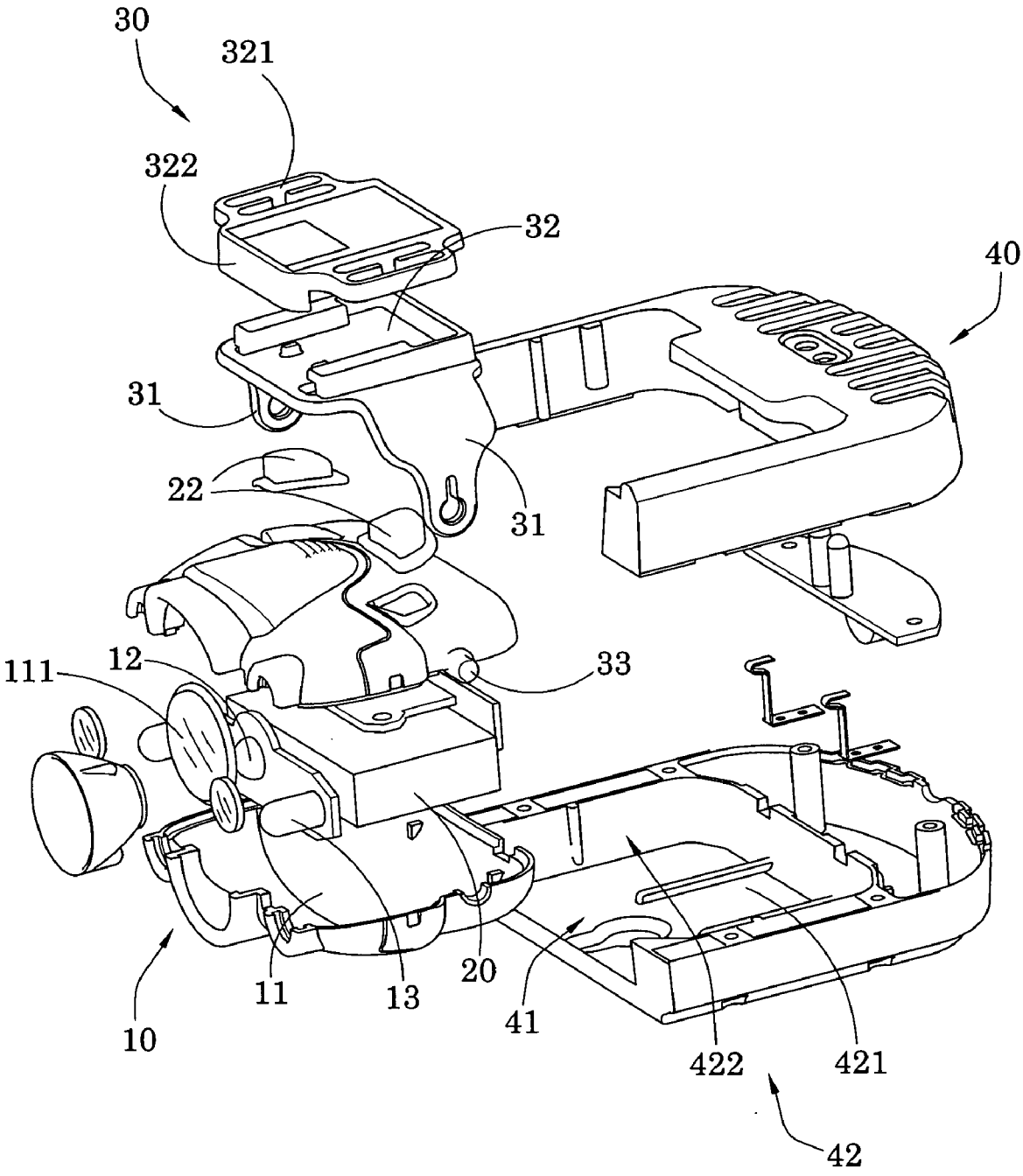
FIG. 6 is an exploded perspective view of the rotatable headlamp according to the above preferred embodiment of the present invention.
Figure 7:
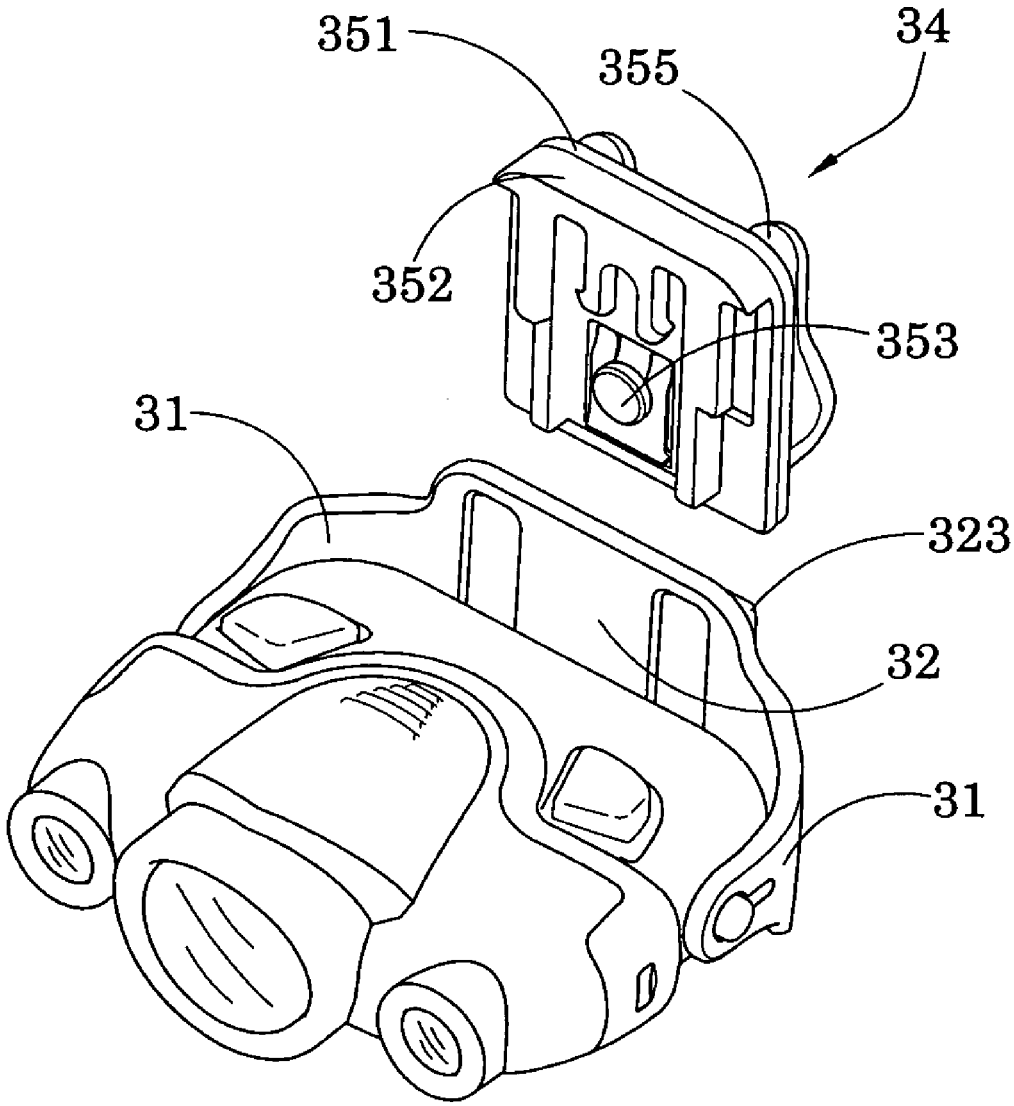
FIG. 7 is another perspective view of the rotatable headlamp according to the above preferred embodiment of the present invention, illustrating a detachably mounting base of the mounting panel being detached from the mounting panel.
Figure 8:
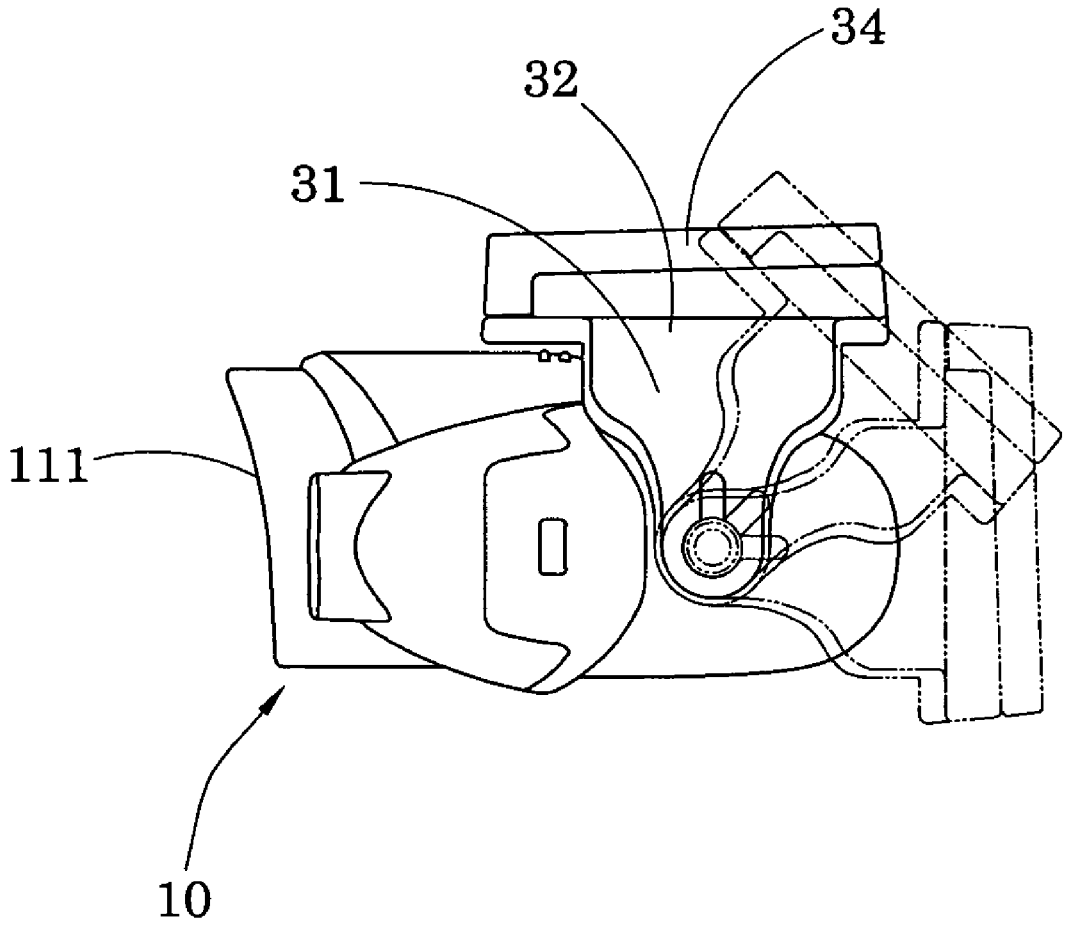
FIG. 8 is another side view of the rotatable headlamp according to the above preferred embodiment of the present invention, illustrating the light head rotatably moving in one-dimension manner.

As shown in FIGS. 6 to 8, the mounting panel 32 of the mounting arrangement 30 further comprises a detachable mounting base 322 forming the plurality of band slots 321 thereon. At least a mounting slot 323 is preferably provided at a rear side of the mounting panel 32 for receiving the mounting base 322, so that the mounting base 322 is able to detachably coupling at the mounting panel 32, so as for coupling the light head 10 to the headband 70. Therefore, the light head is detachably coupling with the headband 70 for being worn on the user's forehead for rotatably adjusting the orientation of the light head in one dimensional manner via the mounting arrangement 30, as shown in FIG. 8.

Figure 9A:
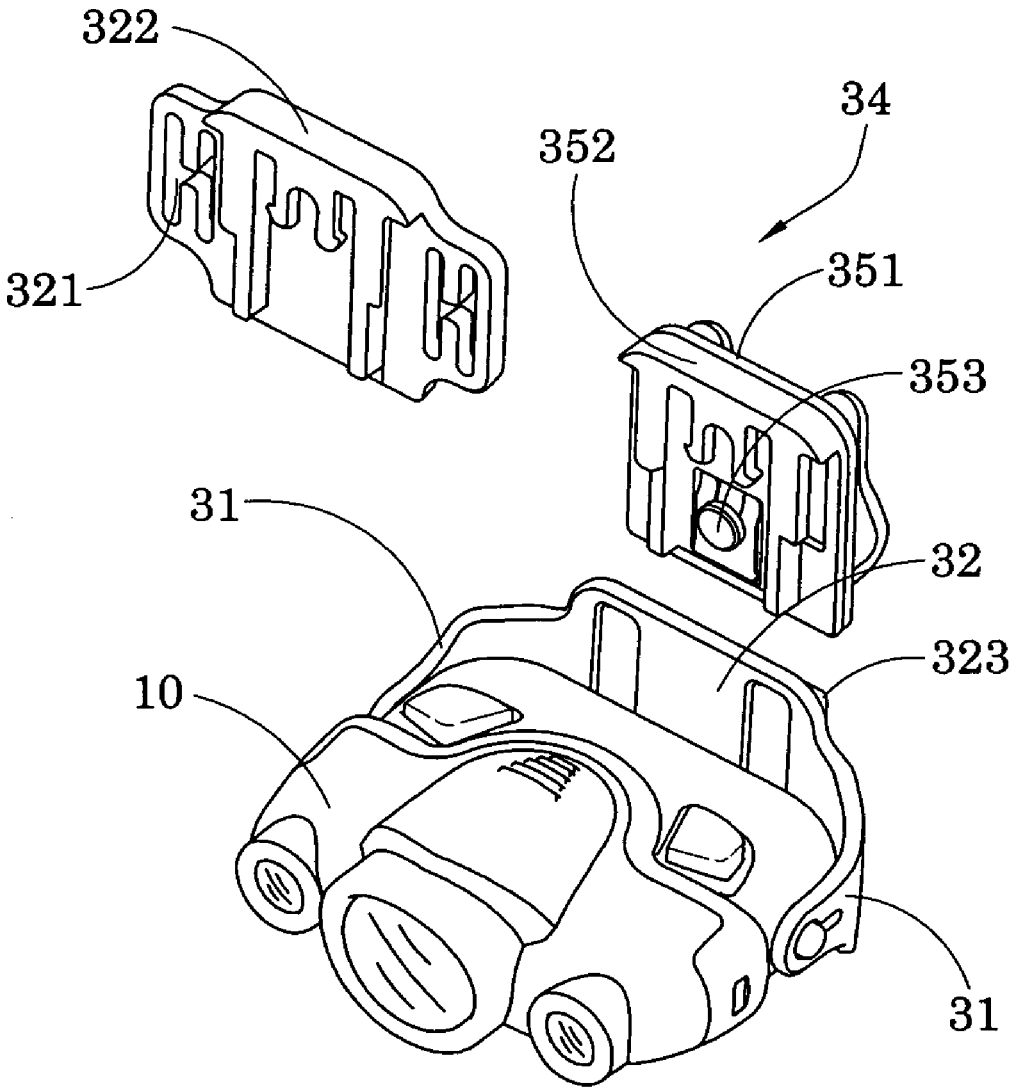
FIG. 9A is another perspective view of the rotatable headlamp according to the above preferred embodiment of the present invention, illustrating a rotating member of the mounting arrangement detachably coupling with the mounting panel, so that the light head is able to move in three-dimensional manner.
Figure 9B:
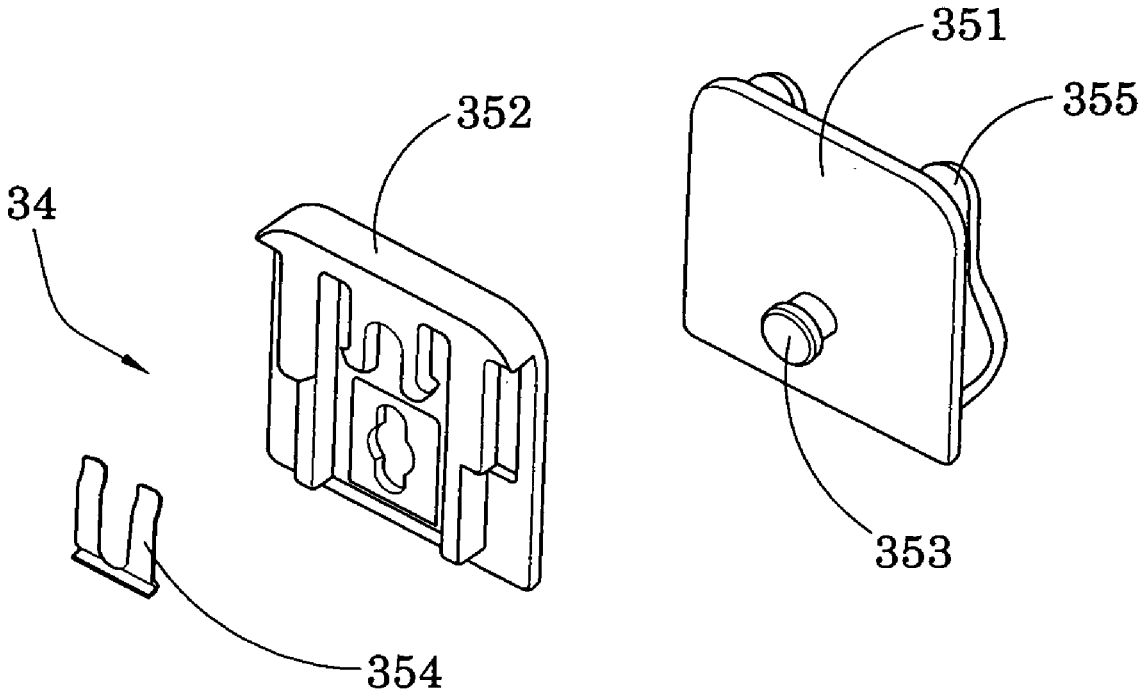
FIG. 9B is an exploded view of the rotating member of mounting arrangement according to the above preferred embodiment of the present invention.

Referring to FIGS. 9A and 9B, the mounting arrangement 30 further comprises a rotating member 34 detachably and rotatably coupling with the mounting panel 32, so that the light head 10 is able to rotatably moving along a plane of the rotating member 34. Therefore, the light head is able to rotate along an axis between the side walls 31 and the light head 10, and the plane of the rotating member 34 in a three dimensional manner.

Accordingly, the rotating member 34 further comprises a detachable base 352 for detachably coupling with the light head 10 via the mounting slot 323, and a rotatable base 351 rotatably coupling with the detachable base 352. In addition, the mounting base 322 and the detachable base 352 are interchangeable to detachably and selectively couple with the mounting panel 32.

As shown in FIG. 9B, the rotatable base 351 comprises a rotatable shaft 353 extended towards the detachable base 325, wherein the detachable base 325 has a through slot for the rotatable shaft 353 of the rotatable base 351 passing through in such a manner that when the rotatable shaft 353 is slidably extended through the through slot of the detachable base 352, the rotatable base 351 is rotatably engaged with the detachable base 352. Accordingly, the detachable base 352 is detachably coupled with the mounting panel 32 such that the rotatable base 351 is rotatably coupled with the mounting panel 32 via the detachable base 352.

According to the preferred embodiment, the rotatable shaft 353 has an enlarged head portion and an elongated neck portion, wherein when the rotatable shaft 353 is slidably passing through the through slot of the detachable base 352, the head portion of the rotatable shaft 353 is located at the front side of the detachable base 352 while the rotatable base 351 is located at the rear side of the detachable base 352.

The rotatable member 34 further comprises a fastener 354 fastening the rotatable shaft 353 at the front side of the detachable base 352 to retain the rotatable base 351 at the rear side of the detachable base 352. Accordingly, the fastener 354 comprises a U-shaped resilient element coupling with the neck portion of the rotatable shaft 353 not only to retain the rotatable base 351 at the rear side of the detachable base 352 but also to apply an urging force between the head portion of the rotatable shaft 353 and the detachable base 352 so as to ensure the rotatable base 351 being overlapped at the rear side of the detachable base 352 in a rotatably movable manner.

As it is mentioned above, the light housing 11 can be freely and pivotally move with respect to the mounting panel 32 for selectively adjusting the angle of illumination by the LED light source 12. In addition, the light housing 11 can also be freely and rotatably moved with respect to the rotatable base 351. Therefore, the rotatable headlamp is able to rotatably and selectively adjust the light projection orientation in three-dimensional manner.

In order to detachably and conveniently position the light head 10 at a predetermined object for illuminating the exterior, the rotatable member 34 further comprises a clip member for detachably clipping the light head 10 onto the predetermined object, wherein the clip member preferably comprises two clipping arms 355 spacedly being mounted at a rear side of rotatable base 351, so that light head 10 is able to adjustably clip at the predetermined object such as a visor of a cap.

The rotatable member 34 is able to detachably attach to the mounting panel 32 via attaching to the mounting base 322 with the band slots 321 or the detachable base 325. In other words, the detachable base 352 and mounting base 322 with the band slots 321 are interchangeable, so that the light head 10 is able to selectively attach to the mounting base 322 or the detachable base 352 for interchanging one of the mounting base 322 for attaching the light head 10 to the headband 70 via the band slots 321 and the detachable base 352 for clipping at the desired object.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rotatable headlamp, comprising:

a light head comprising a light housing having a light window, and a LED light source supported in said light housing to align with said light window;

a rechargeable power source supported in said light housing; and a mounting arrangement adapted for detachably mounting at a desired object, wherein said mounting arrangement is movably coupling with said light housing to selectively adjust a light projecting orientation of said LED light source through said light window with respect to the desired object, wherein said mounting arrangement comprises two retention walls rotatably coupling with two sides of said light housing to selectively adjust said light projecting orientation of said LED light source, and a mounting panel extended between said retention walls to form a U-shaped member;

wherein said mounting arrangement further comprises a rotatable member detachably and rotatably coupling with said mounting panel such that said light housing is rotatably and pivotally moved in a three-dimensional manner;

wherein said rotatable member comprises a detachable base detachably coupling with said mounting panel, and a rotatable base rotatably coupled with said detachable base such that said light housing is pivotally moved with respect to said mounting panel and is rotatably moved with respect to said rotatable base so as to adjustably move said light housing in a three-dimensional manner.

2. The rotatable headlamp, as recited in claim 1, wherein said rotatable base comprises a rotatable shaft extended through a through slot of said detachable base, and a fastener fastening said rotatable shaft at a front side of said detachable base to retain said rotatable base at a rear side of said detachable base.

3. The rotatable headlamp, as recited in claim 2, wherein said fastener comprises a resilient element coupling with an elongated neck portion of said rotatable shaft not only to retain said rotatable base at said rear side of said detachable base but also to apply an urging force between an enlarged head portion of said rotatable shaft and said detachable base so as to ensure said rotatable base being overlapped at said rear side of said detachable base in a rotatably movable manner.

4. The rotatable headlamp, as recited in claim 2, wherein said rotatable member further comprises a clip member provided at a rear side of said rotatable base for detachably clipping said light head at a desired object.

5. The rotatable headlamp, as recited in claim 3, wherein said rotatable member further comprises a clip member provided at a rear side of said rotatable base for detachably clipping said light head at a desired object.

6. The rotatable headlamp, as recited in claim 2, wherein said mounting arrangement further comprises a mounting base, which is interchangeable with said rotatable member, detachably coupling with said mounting panel, wherein said mounting base has a plurality of band slots spacedly formed thereat for a headband detachably fastening at said mounting base so as to enable said light head being carried at a head portion of a user via said headband.

7. The rotatable headlamp, as recited in claim 5, wherein said mounting arrangement further comprises a mounting base, which is interchangeable with said rotatable member, detachably coupling with said mounting panel, wherein said mounting base has a plurality of band slots spacedly formed thereat for a headband detachably fastening at said mounting base so as to enable said light head being carried at a head portion of a user via said headband.

8. The rotatable headlamp, as recited in claim 3, further comprising a rechargeable dock, which is adapted for electrically connecting with an external power supply, having a docking cavity detachably receiving said light head to charge said rechargeable power source.

9. The rotatable headlamp, as recited in claim 7, further comprising a rechargeable dock, which is adapted for electrically connecting with an external power supply, having a docking cavity detachably receiving said light head to charge said rechargeable power source.

10. The rotatable headlamp, as recited in claim 9, said light head further comprises two auxiliary light sources provided at said light housing at a position that said LED light source is positioned between said auxiliary light sources, wherein each of said auxiliary light sources has the same light projecting orientation of said LED light source.

11. The rotatable headlamp, as recited in claim 10, wherein said rechargeable power source comprises two switch controls spacedly provided at said light housing for controllably switching said LED light source and said auxiliary light sources in an on and off manner, wherein one of said switch controls is arranged to switch one of said LED light source and said auxiliary light sources in an on and off manner, while another said switch control is arranged to switch between a main light mode and an auxiliary light mode, wherein said main light mode is that said LED light source is activated and said auxiliary light mode Is that said auxiliary light sources are activated.

12. A rotatable headlamp, comprising:

a light head comprising a light housing having a light window, and a LED light source supported in said light housing to align with said light window;

a rechargeable power source supported in said light housing; and a mounting arrangement adapted for detachably mounting at a desired object, wherein said mounting arrangement is movably coupling with said light housing to selectively adjust a light projecting orientation of said LED light source through said light window with respect to the desired object, wherein said mounting arrangement comprises two retention walls rotatably coupling with two sides of said light housing to selectively adjust said light projecting orientation of said LED light source, and a mounting panel extended between said retention walls to form a U-shaped member;

wherein said mounting arrangement further comprises a rotatable member detachably and rotatably coupling with said mounting panel such that said light housing is rotatably and pivotally moved in a three-dimensional manner;

wherein said rotatable member comprises a detachable base detachably coupling with said mounting panel and a rotatable base rotatably coupled with said detachable base;

wherein said rotatable base comprises a rotatable shaft extended through a through slot of said detachable base, and a fastener fastening said rotatable shaft at a front side of said detachable base to retain said rotatable base at a rear side of said detachable base.

13. The rotatable headlamp, as recited in claim 12, wherein said fastener comprises a resilient element coupling with an elongated neck portion of said rotatable shaft not only to retain said rotatable base at said rear side of said detachable base but also to apply an urging force between an enlarged head portion of said rotatable shaft and said detachable base so as to ensure said rotatable base being overlapped at said rear side of said detachable base in a rotatably movable manner.

* * * * *